US007201531B2

(12) United States Patent
Shackelford et al.

(10) Patent No.: US 7,201,531 B2
(45) Date of Patent: Apr. 10, 2007

(54) VEHICLE SKIDSTOP

(76) Inventors: Brian Shackelford, 9636 W. Avenida, Del Sol, Peoria, AZ (US) 85382; Timothy J. Crawley, 5822 W. Purdue, Glendale, AZ (US) 85302; Donald J. Booty, Jr., 5522 E. Dusty Wren Dr., Cave Creek, AZ (US) 85331; James M. Borelli, 4418 Myrtle Ave., Glendale, AZ (US) 85301

( * ) Notice: Subject to any disclaimer, the term of this patent is extended or adjusted under 35 U.S.C. 154(b) by 0 days.

(21) Appl. No.: 11/069,295

(22) Filed: Mar. 1, 2005

(65) Prior Publication Data

US 2005/0244223 A1 Nov. 3, 2005

Related U.S. Application Data

(60) Provisional application No. 60/549,452, filed on Mar. 1, 2004.

(51) Int. Cl.
*E01F 13/12* (2006.01)

(52) U.S. Cl. ..... 404/6

(58) Field of Classification Search .. 404/6; *E01F 13/12*

See application file for complete search history.

(56) References Cited

U.S. PATENT DOCUMENTS 4,382,714 A * 5/1983 Hutchison ..... 404/6
5,123,774 A * 6/1992 Dubiel ..... 404/6
5,498,102 A * 3/1996 Bissell ..... 404/6
5,611,408 A * 3/1997 Abukhader ..... 180/287
5,839,849 A * 11/1998 Pacholok et al. ..... 404/6
6,206,608 B1 * 3/2001 Blevins ..... 404/6
6,322,285 B1 * 11/2001 Ben ..... 404/6
6,474,903 B1 * 11/2002 Marts et al. ..... 404/6
7,025,526 B2 * 4/2006 Blair ..... 404/6

FOREIGN PATENT DOCUMENTS

FR 2 714 404 * 6/1995
GB 2 253 430 * 9/1992

* cited by examiner

*Primary Examiner*—Gary S. Hartmann
(74) *Attorney, Agent, or Firm*—National IP Rights Center LLC

(57) ABSTRACT

A device for stopping a moving vehicle is provided. The device consists of a strip containing a plurality of spikes which are attached to a common cable. When a vehicle rolls over the strip, the spikes pierce the vehicle's tire and expand inside the tire, causing the spikes to become securely lodged inside. The forward motion of the vehicle pulls the attached cable forward, causing the cable to entwine the axle of the vehicle's wheel. The spinning of the wheels causes the cable to become taut, which in turn causes the vehicle to skid to a stop.

8 Claims, 12 Drawing Sheets

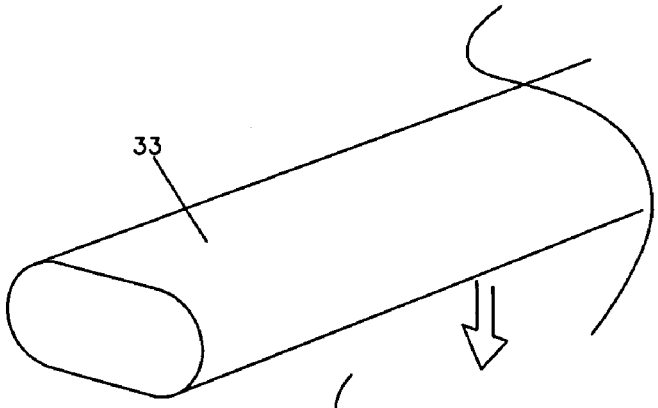
FIG. 12
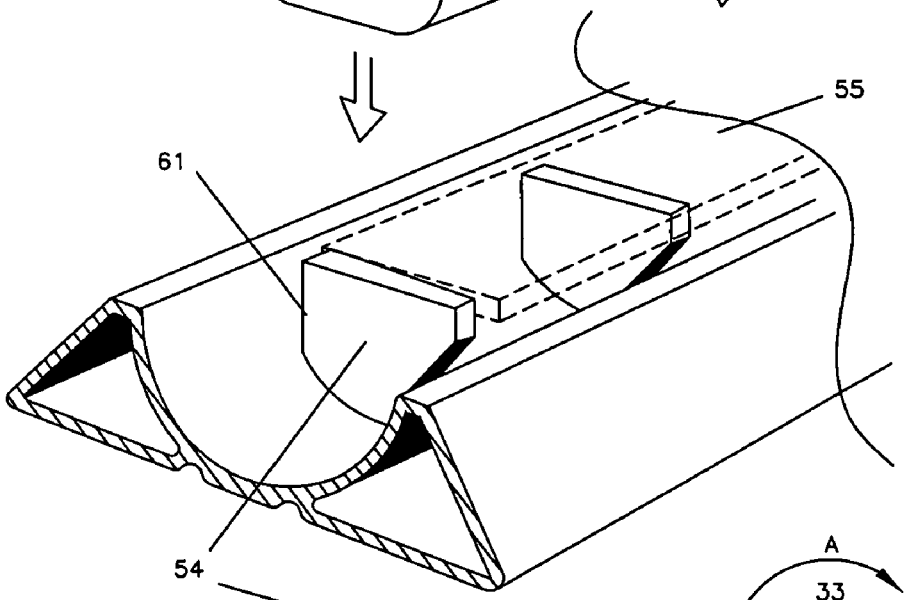
FIG. 13
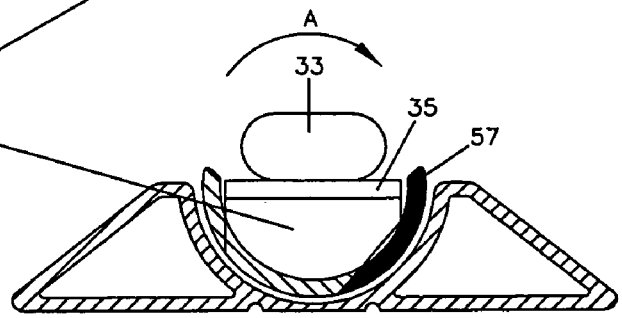

VEHICLE SKIDSTOP

CLAIM OF PRIORITY

This application claims priority of U.S. Ser. No. 60/549,452 filed Mar. 1, 2004.

FIELD OF THE INVENTION

The present invention is directed to vehicle pursuit and checkpoint control systems. In particular, the present invention is directed to a mechanical wheel entangling device, intended for law enforcement use, which is designed to stop a fleeing motor vehicle by locking up the front wheel(s) of the vehicle.

BACKGROUND OF THE INVENTION

One of the most serious law enforcement issues is the life-threatening problem caused by high-speed chases. Such chases take lives, cause injuries and cause considerable property damage. A number of states and localities have outlawed law enforcement from engaging in high-speed pursuits for public safety reasons.

Additionally, control of vehicles at checkpoints such as borders, military bases or security perimeters, is or major concern to both civilian and military agencies in an ongoing War on Terror.

Because of the public safety issues as expressed in the preceding paragraphs, a number of prior art systems and devices have been developed for stopping vehicles in a high speed chase, fleeing or checkpoint-running situations. A number of these devices involve the rapid deflation of tires. The problem with the mechanisms of this type of device is that while they rapidly deflate the tires they do not stop the vehicle. Fleeing criminals often continue to drive the vehicles with deflated tires sometimes at speeds up to 25 miles per hour. A vehicle under the control of a fleeing felon going 20 mph is still a hazard to life and limb. Some fleeing criminals have been known to drive a vehicle on the tire rims for several miles and only stop when the vehicle catches fire, is otherwise disabled, or stopped, all of which constitute potential public safety hazards. Hence, tire deflation systems at best only slow rather than stop the vehicle and are therefore not a complete solution.

Another system involves the use of electromagnetic pulses. Such pulses produce a strong electromagnetic field which overrides the electrical system of the vehicle and stalls the engine. The problem with these systems is that they are large, bulky and expensive. More importantly, they are not targeted in their usage and effect. Such systems may disable other vehicles and even low flying planes and can impact medical devices such as the cardiac pacemakers and hearing aids of bystanders, thus producing a collateral risk to life and limb.

A number of prior art patents have issued which disclose systems for rapidly deflating vehicle tires. U.S. Pat. No. 5,498,102 discloses a tire puncturing spike strip, which can be placed on a road surface in front of a moving vehicle. The spike strip is comprised of essentially rectangular modular frame units with low height for easy storage in a trunk of a police vehicle, and the frame units have interlocking ends which can be quickly assembled in any desired length for placement across a roadway with spikes in a normal down position to allow safe passage of vehicles over the strip, but said spikes may be selectively and remotely activated to their up position electromechanically by an operator to target a specific fleeing vehicle. Once the fleeing vehicle crosses over the strip, the spikes may be electromechanically returned to their down position to allow pursuing police cars to safely cross over the strip and apprehend the disabled fleeing vehicle.

U.S. Pat. No. 4,818,029 discloses an anti-theft device for a pneumatic-tired vehicle, of the kind comprising means for automatically deflating a tire of the vehicle and deflating the tire when the device is actuated by control means and the vehicle is in motion, the deflating means being moved by the centrifugal force of inertia when the corresponding wheel rotates whereas they are inoperative in other cases, characterized in that the deflating means comprise movable means for closing at least one orifice through which air under pressure can escape from the tire, the movable closing means normally sealing the orifice when the device is inoperative and/or the wheel is stationary, whereas they unclose the orifice and allow air to escape when the device is actuated and as soon as the centrifugal force of inertia reaches a sufficient value to move them.

U.S. Pat. No. 4,318,079 discloses a motorized traffic-way controller wherein a retractile tire barrier and opening gate barrier are coordinated to operate in unison by a motor drive that is recycled by closing a mode switch through cam controlled "stop" and "go" switches responsive to the position of the motor drive, the installation being above grade with low profile modules having retractile tooth configurations that project for tire damage, and with a signal barrier supported by a drive unit at the side of the traffic-way and in the form of an arm that is lifted when the tooth configuration is retracted, the modules and drive unit being adapted to coupled engagement one with the other when assembled.

U.S. Pat. No. 4,820,166 discloses an apparatus for selectively deflating and inflating a tire mounted on a wheel which comprises a valve assembly rigidly and coaxially mounted on a vehicular wheel incorporating a reciprocally movable valve body received in a cavity of a valve housing, the valve body having a plurality of channels for directing gas to gas outlet ports for pressurizing the tire, the valve body moving to a first position to close off a gas exhaust port in the valve housing and a second position to open the exhaust port when pressurized gas to the valve from a pressurized gas source is terminated. The valve assembly includes a valve member movably secured on the valve body alternately opening and closing the gas directing channels as the valve body is moved between the first and second positions. In a driver education system additional power steering and power brake failure assemblies are incorporated.

U.S. Pat. No. 4,995,756 discloses a vehicle tire deflator comprising a foldable and extendible frame with one or more rocker arms releasably carrying hollow spikes and having rocker arm actuators attached to the rocker arms to pivot said arms to position the spikes to enter a tire rolling over the deflator and to hold the rocker arm in position as the spike is withdrawn from the rocker arm.

U.S. Pat. No. 5,253,950 discloses an improved vehicle tire deflator that is foldable and can be deployed by pushing it or pulling it to an extended attitude across at least one full traffic lane. The deflator includes a plurality of rocker arms that are each pivotally coupled to base supports, forming a frame that is collapsible and when extended, includes a stop arrangement for holding the rocker arms apart. The rocker arms each include a plurality of actuators that incorporate spaced center holed and countersunk spike base bosses, each boss to accommodate an end of a hollow spike and attached resilient grommet fitted therein. When a tire rolls onto a rocker arm actuator, that rocker arm is canted towards the rolling tire tread, directing a hollow sharp spike into the tire tread to lodge therein as the tire continues to roll over the actuator, the resilient grommet absorbing forces as are exerted by the tire rolling over the hollow spike pointed end and the hollow spike is pulled out from its spike base boss seat and travels fully into the tire, allowing air from within that tire to vent therethrough.

Alternatively, for penetrating a steel belted tire, or the like, an insert that is formed of a hard steel, or the like, and has a pointed end can be fitted longitudinally into and maintained in each hollow spike, the insert pointed end to extend beyond the hollow spike pointed end to first contact the tread of a tire rolling thereover.

U.S. Pat. No. 3,967,704 discloses a safety device for quickly arresting the movement of vehicles such as aeroplanes and motorcars by forming a retarding bed of crushable material adjacent to a vehicle track. A foam is formed from an aminoplast resin composition and layed down in a bed adjacent to the vehicle track where it is cured to produce a non-resilient cured foam body having a compressive strength between 15 and 50 p.s.i. and a density from 0.25 to 10 pounds per cubic foot.

As noted, there are a large number of prior art systems which deflate tires on a rapidly moving vehicle. All of these systems do not adequately address the need to completely arrest a moving vehicle, or otherwise safely stop a vehicle without further interaction or intervention by law enforcement, and with a minimized risk to the public.

It is an object of the present invention to improve other prior art tire inflation systems which only slow rather than stop fleeing vehicles.

It is another object of the present invention to provide a system which deflates the tire of a vehicle while simultaneously stopping the vehicle by locking the wheels of the vehicle, thus preventing their rotation.

It is a further object of the present invention to provide a system which provides a novel system including a cable which entwines and stops the vehicle tires form spinning thus bringing the vehicle to a stop.

These and other objects of the present invention will become apparent from the detailed description which follows.

SUMMARY OF THE INVENTION

The present invention is broadly directed to a device which is deployed in front of a moving vehicle sought by law enforcement or for checkpoint control at borders, military bases, security perimeters, etc. When the front tires of the vehicle roll over the device, a series of hooks or spikes will penetrate the tires and open into a flared position once inside. A long cable or bungee, approx 20–30 feet in length but not limited to this range of length, attached to the hooks or spikes will thereafter unwind from the center of the housing and wrap around the axles or otherwise impede wheel or tire rotation as the cable anchors to the vehicle underside as the wheels continue turning. When the slack runs out of the cable/bungee, the front tires will lock up and skid to a stop.

In accordance with the present invention a device for stopping a moving vehicle comprising: an elongated enclosure to be placed on a roadway in front of the vehicle to be stopped said strip having a plurality of spikes for puncturing the tires; a cable attached to spikes which unwinds and entwines the axle of the wheels proximate to the tire and stopping its rotation. In alternative embodiments, the cable comprises an elastic material, reinforced steel, or synthetic material.

In a further embodiment, the invention comprises a device for stopping a moving vehicle comprising: an inclined strip to be placed on a roadway in front of the moving vehicle; said strip having a plurality of recessed spikes for thrusting into the front tires of the vehicle; and an elongated cable affixed to the spikes for unwinding and entwining the wheels of the tires as the vehicle advances forward so as to stop the rotation of the tires and thus stopping the vehicle wheels.

In still a further embodiment, the invention comprises a device for stopping a moving vehicle comprising: an inclined strip to be placed on a roadway in front of the moving vehicle; said strip having a plurality of recessed spring loaded spikes for thrusting into the front tires of the vehicle when activated; an elongated cable affixed to the spikes for unwinding and entwining the wheels of the tires as the vehicle advances forward so as to stop the rotation of the tires and thus stopping the vehicle wheels.

In yet a further embodiment, the invention comprises a device for stopping a moving vehicle comprising: an inclined strip to be placed on a roadway in front of the moving vehicle; said strip having a recess for supporting a rotating member, said rotating member having a disarmed position and an armed position having a plurality of recessed spring loaded spikes for thrusting into the front tires of the vehicle when armed; an elongated cable affixed to the spikes for unwinding and entwining the wheels of the tires as the vehicle advances forward so as to stop the rotation of the tires and thus stopping the vehicle wheels.

In yet a further embodiment, a device for stopping a moving vehicle comprising: a strip to be placed on a roadway in front of the moving vehicle; said strip having a plurality of oppositely disposed recessed spring loaded spikes for thrusting into the front tires of the vehicle when activated; an elongated cable affixed to the spikes for unwinding and entwining the wheels of the tires as the vehicle advances forward so as to stop the rotation of the tires and thus stopping the vehicle wheels.

BRIEF DESCRIPTION OF THE FIGURES

FIGS. 12 and 13 illustrate the internal mechanism of the third embodiment.

DETAILED DESCRIPTION OF THE INVENTION

Figure 1:
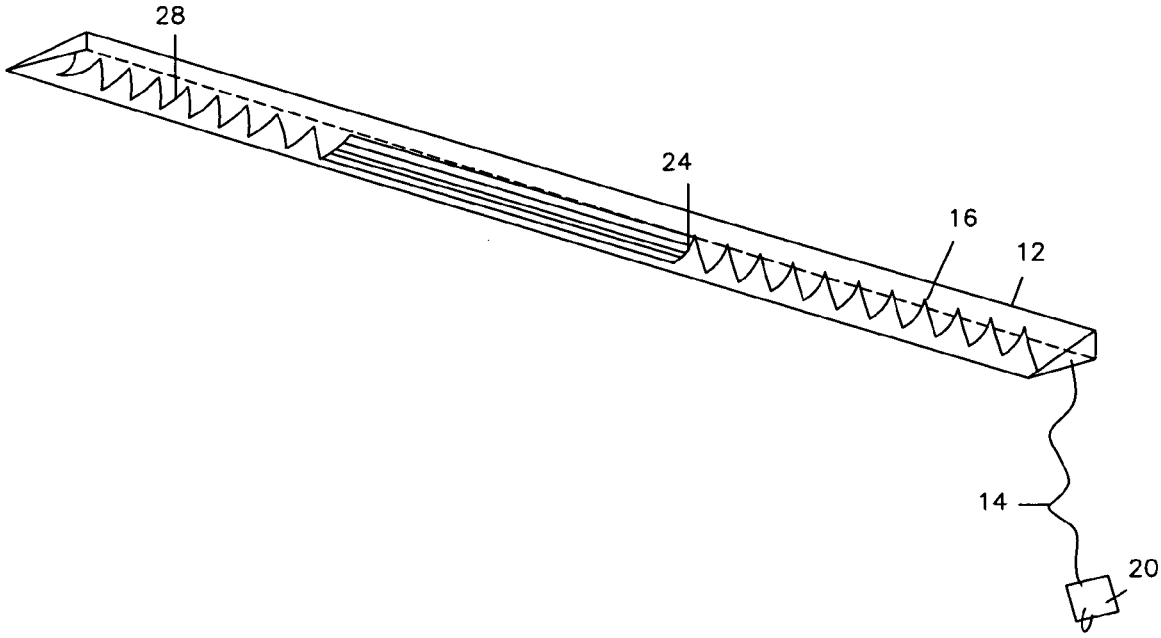
FIG. 1 is a perspective view of the system of the present invention.

The present invention is described with reference to the enclosed figures wherein the same numerals are used where applicable. Referring to FIG. 1, the present invention is broadly directed to a system for stopping a fleeing vehicle. It comprises a number of core elements. The initial element 12 is an angled housing 8 to 12 feet in length. Preferably the housing 12 comprises a rebuildable/reusable polymer or material designed to splinter as hooks engage and cable unwinds to be described further herein.

In one embodiment, the housing 12 may be foldable in the middle, or compile two separate attachable pieces, for storage in a patrol car and for quick and easy deployment. A rope or cord 14 with a handle connected to either end of the housing can be used for last second adjustments should the driver attempt to avoid this device.

Figure 2:
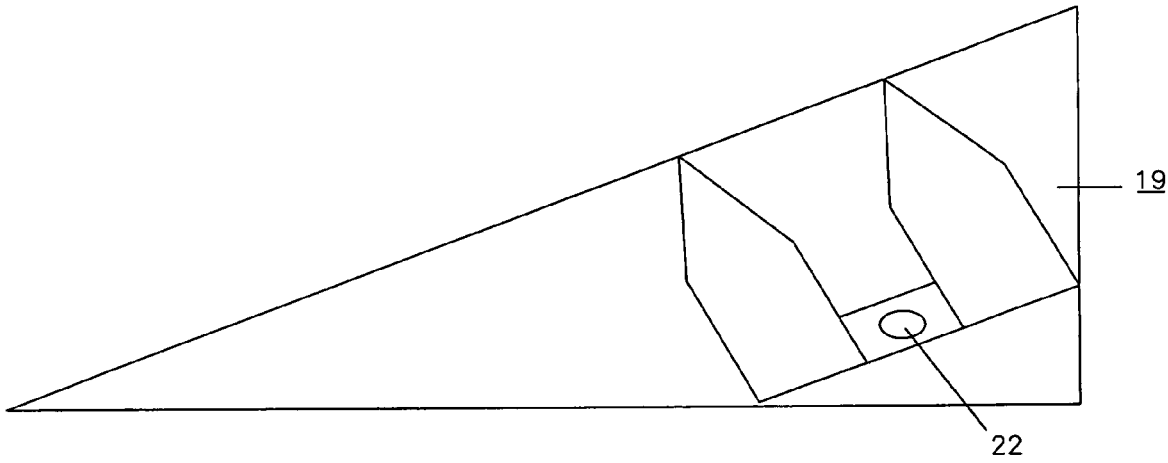
FIG. 2 is a side perspective view of the present invention.
Figure 3:
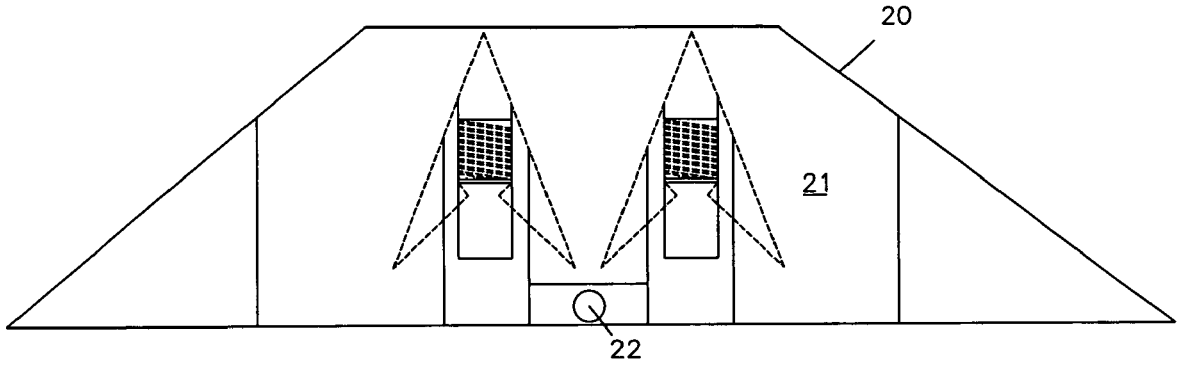
FIGS. 3 to 6 illustrate alternative spike embodiments of the present invention.

The housing 12 stores a plurality of spring-loaded spikes 16, designed to puncture the tires of a vehicle. The device further includes a cable 24 which is designed deploy with the spikes to stop the wheels of the vehicle. A disarming mechanism 20 may be integrated into the housing to cover spikes/hooks, allowing pursuing officers to drive over device. FIG. 2 illustrates an embodiment in which the housing 12 is beveled and the spikes 16 are recessed and retracted in an angled configuration. FIG. 3 illustrates an embodiment where the housing 12 is flat and the spikes are vertical.

Figure 4:
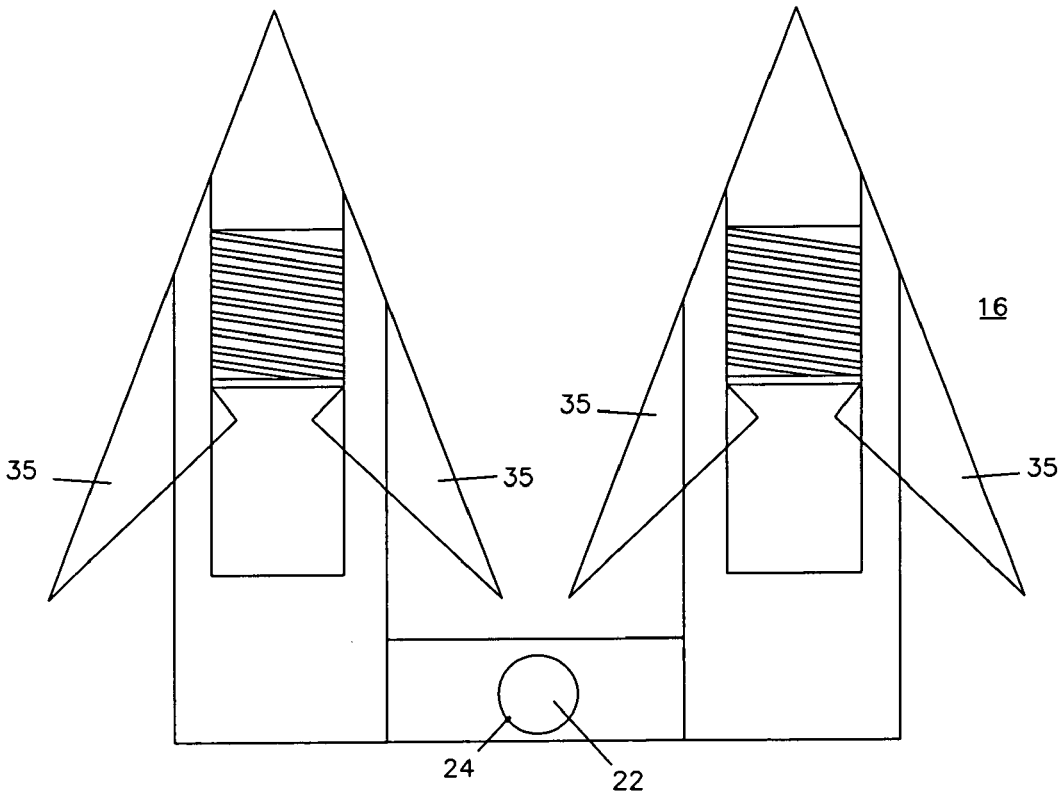
Figure 5A:
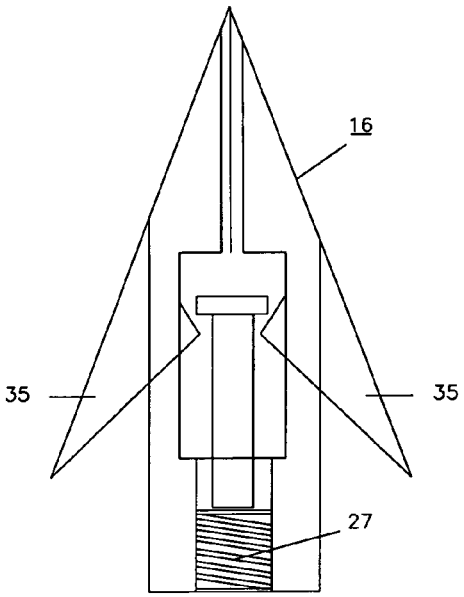

Referring to FIGS. 3 to 5, a spring-loaded spike 16 embodiment is shown wherein the spike with retractable barbs or possibly a 4 to 6 point broadhead design, having retractable or non-retractable blades, 2 to 4 inches in length. In a preferred embodiment, the spikes will be placed on 1 to 3 inch centers in the housing so that a minimum of 2 to 4 hooks will engage even the smallest tires. The spikes are against a compressed spring 27. As shown in FIGS. 3 and 4, the spikes may be connected to each other in pairs to minimize the cable mounting points.

Figure 5B:
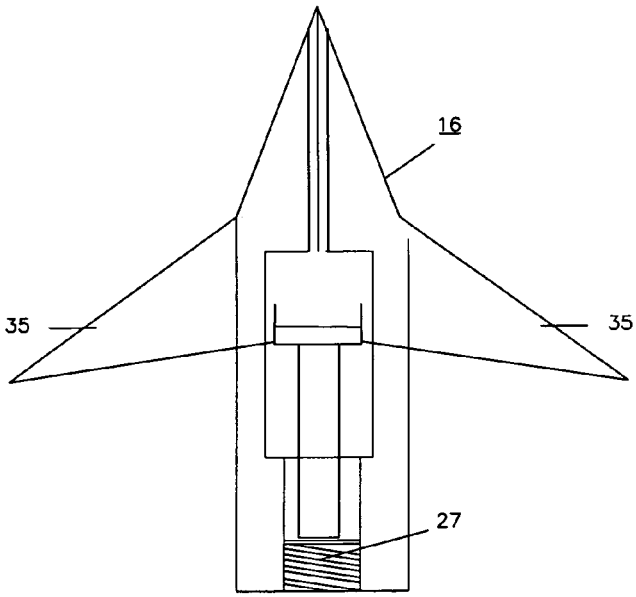
Figure 6A:
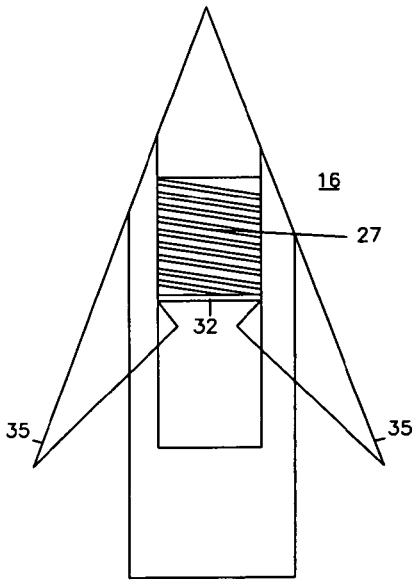
Figure 6B:
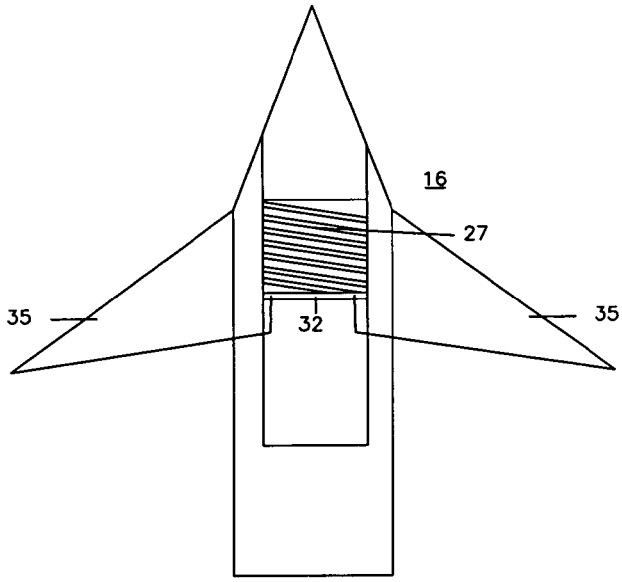
Figure 7:
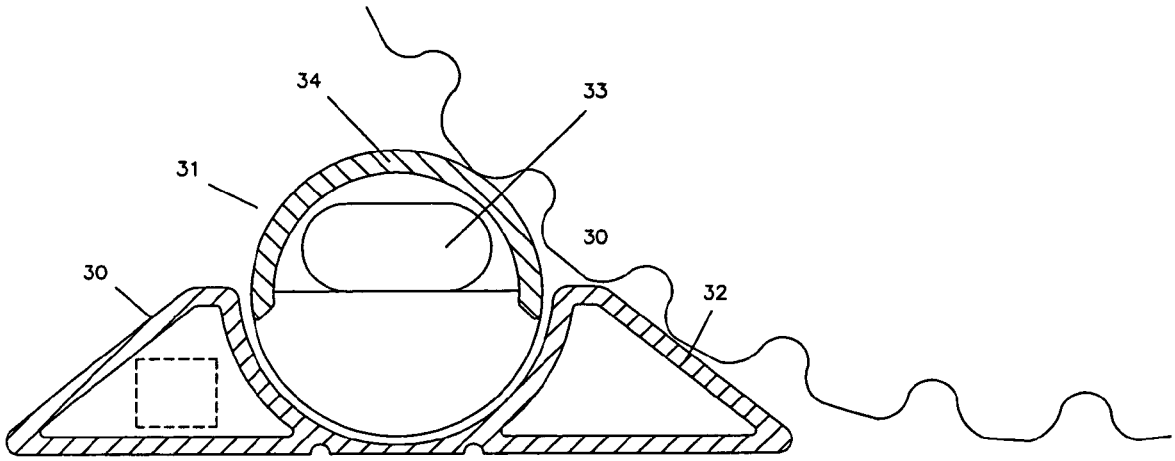
FIG. 7 is a section view of a third embodiment of the invention.

As noted, a plurality of spike embodiments is suggested as shown in FIG. 5. When a spike punctures a tire, compressed air travels down the center of spike and pushes plunger down, which in turn pushes ratcheting barbs outward, locking in an open/flared position. The barbs 35 are shown in the flared out position in FIG. 5*b*. This style of spike may be preferably designed to release air slowly. FIG. 6 shows a spring-loaded assembly 27 which is preloaded inside spike 16 with an O-Ring retainer 32 around the outside of the spike. When a spike punctures tire, a retainer 34 is pushed down and internal spring tension is released, pushing barbs 35 outward into a locking flared position. The barbs 35 are shown in the flared out position in FIG. 6*b*.

In a preferred embodiment, the spikes are designed to penetrate and flare, or alternatively to penetrate, already flared, so that once inside the tire, they cannot be retracted. As shown, the spikes may be designed to flare utilizing escaping air pressure from tire 20. The spikes can also be charge activated, using a small blasting cap/powder charge to drive a spike into the tire. In all cases, the spikes must have a hoop or ring 22 attached to side or bottom for attaching cable as shown in FIG. 2.

The critical feature of the invention is the inclusion of a cable or cord 24. The cable or cord 24 preferably has 10 to 30 feet in length connecting one side of spikes to the other. In a preferred embodiment, the cable 24 may comprise a stretch design, comprising a heavy spring/bungee. In an alternative embodiment, a hydraulic/pneumatic device absorbs cable tension allowing the stop to be more gradual. The cord may further comprise or include reinforced steel or be fabricated of a synthetic material.

In one preferred embodiment, a spool/tensioner may also be included to unwind cable and permit slow release. The cable may also be covered with a gripping material such as soft plastic or possible rubber compound so that it will adhere better to suspension components.

In operation, when the fleeing vehicle rides over the system, the spikes 16 are engaged thus deploying into the front tires and leading to deflation. The cord 24 is attached to the spikes 16 via rings 22. As the vehicle proceeds forward, the cord 24 unwinds and is deployed between the axles. The cord 24 wraps around the vehicle's front drive wheels, locking the same and stopping the vehicle.

It must be emphasized that the present invention does not stop the vehicle, only the rotation of the front tires. By locking the tires, the vehicle comes to a skidding stop. The invention may include an equalizing system in the cable, so that in the event that the one side unwinds faster than the other, the fleeing vehicle will not go out of control when one wheel/tire locks up before the other.

In situations where the spikes only penetrate one tire, an electric switch located in a handle will activate an electrical breakaway connector placed between the spike assembly and cable on either side and be activated by the officer attempting deployment. A battery/electrical supply can be placed proximate to the handle if needed.

It is anticipated that the invention can be used with other conventional law enforcement technologies. The system of the prevent invention may be extremely useful when used in conjunction with an aircraft. In such a situation, a law enforcement pilot would advise ground officers of an appropriate location for deployment (narrow lane or street). The vehicle can be stopped, minimizing danger to the public and law enforcement.

A further embodiment of the invention is shown at FIGS. 7 to 14. The embodiment of these Figures is fabricated primarily for polymer composites. It is not limited to these materials. The device comprises a first external assembly 31 of two heavy-gauge wall parts 30 capable of handling continuous heavy load vehicle flow . In profile, a first triangular part 32 forms the base; a second half-circular part (profile) 34 rotates 180 degrees within the base part 32, attached at either end and driven by electric motor. In disarmed mode, the rotating part 34 is closed, the assembly forming a ramp over which vehicles safely travel. Further, the device can be hooked in position by means of slots.

Figure 8:
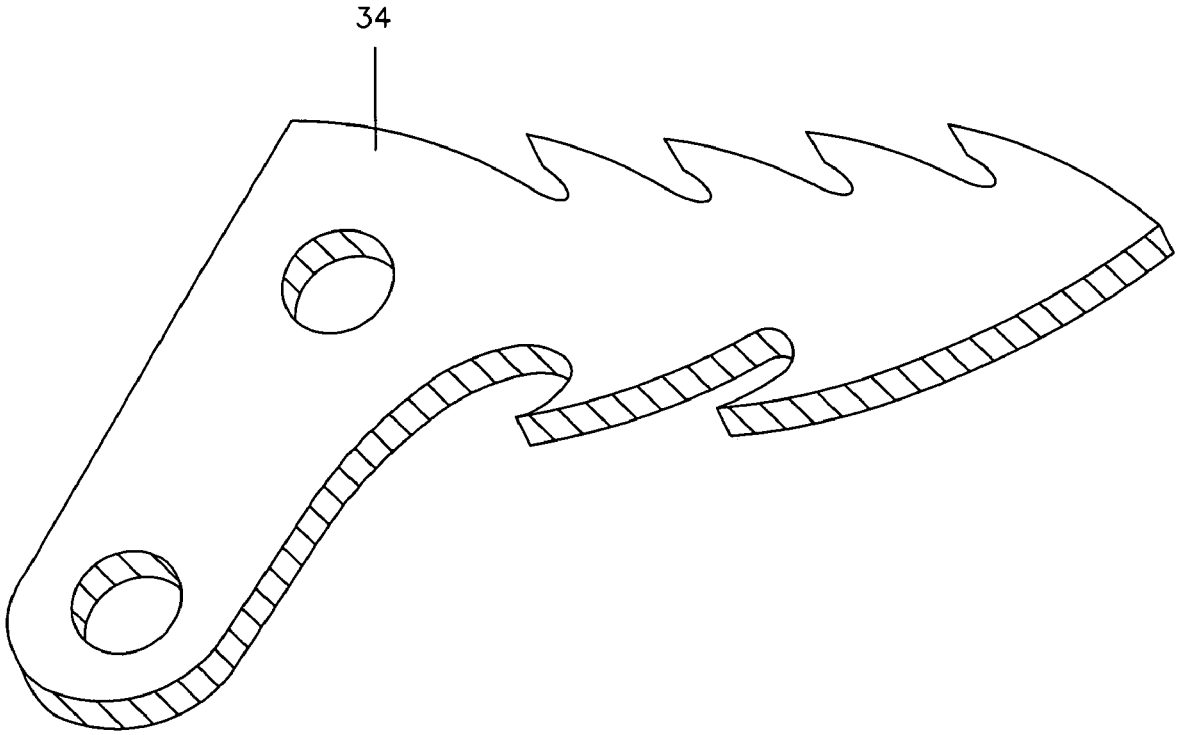
FIG. 8 is a perspective view of a spike of the present invention.

The first external housing 31, which is designed as a portable speed bump in its disarmed mode, houses the skid-stop device 33, which is a thin wall enclosure with an internal assembly of barbed spikes 34 similar in design to a fishing hook as shown in FIG. 8.

Figure 9:
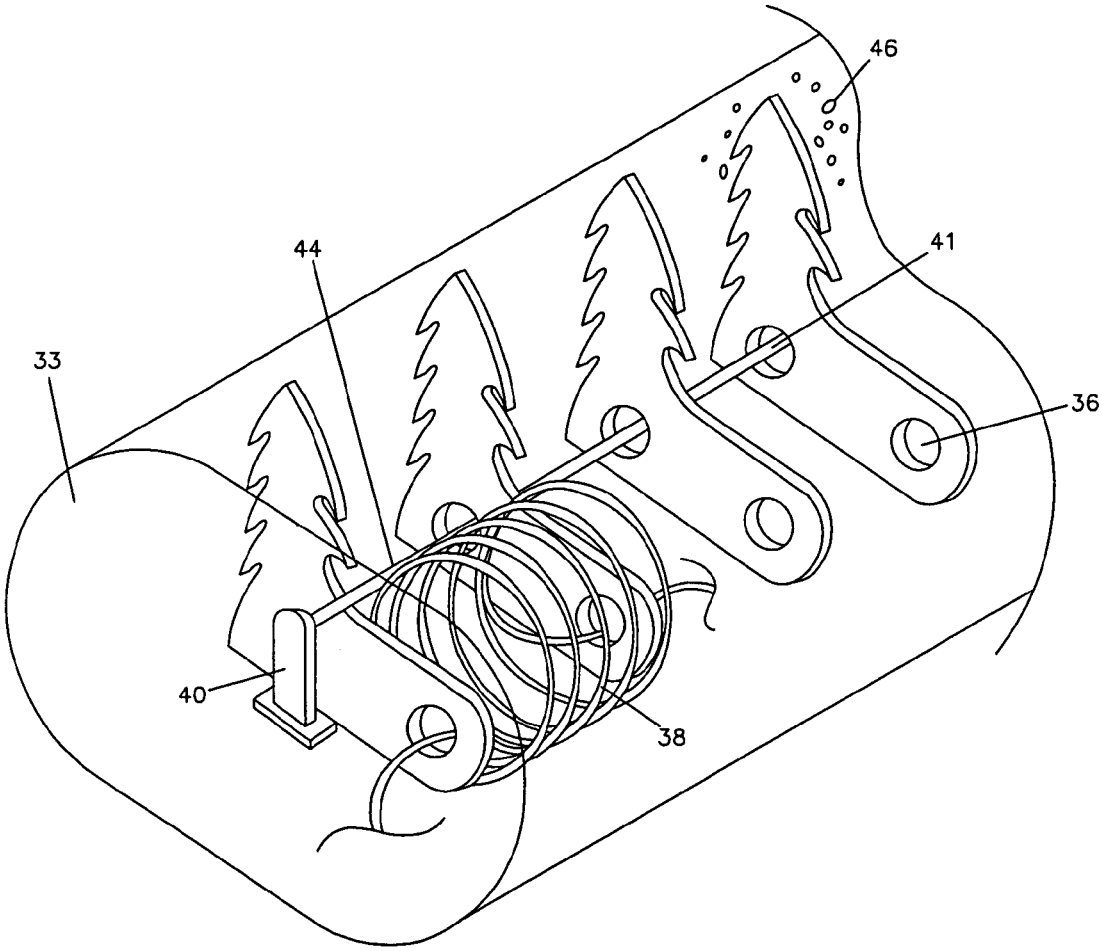
FIG. 9 is an isolated view of the assembly of the present invention.

The spikes are spaced approximately 1.5" apart, and in one embodiment, are aligned as shown in FIG. 9. A through-hole 36 on the distal section of each spike 34 (its proximate section being described as that section which includes the barbs) allows the pass-through of a steel cable 38, which is coiled between each spike 34, also shown in FIG. 9. This allows sufficient slack and cable length. These through-holes 36 are aligned on one axis through the assembly.

Referring still to FIG. 9, polymer brackets 40 support and position the spikes on either side, inserting a circular protrusion 42 into the proximate through-hole 41 of the spike 34 in one embodiment or designed with a corresponding through-hole in an alternate embodiment, through which a plastic rod 44 is then inserted into the through-holes 30 of both bracket 40 and spike 34. In either embodiment, the bracket 40 and/or rod 44 are designed to shear once a tire impales the spike, and by the energy of its rotation, pulls the spike out of its assembled position.

Both the bracket 40 and steel cable 38 dissipate the energy of the vehicle in dislodging, and then pulling them, from the skid-stop assembly. The vehicle's energy is further dissipated with foam injected 46 into the assembly thin-wall housing, providing additional drag on its forward inertia.

Figure 10:
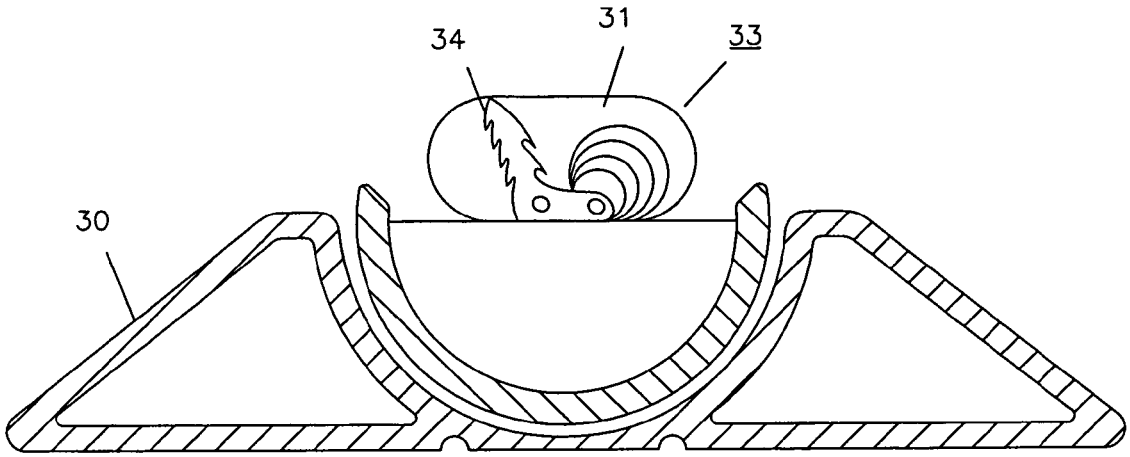
FIG. 10 illustrates the assembly of the invention in an armed mode.

In armed mode, seen in FIG. 10, the thin-wall housing 31 of the assembly is exposed to collapse by a moving vehicle. Upon front tire impact, barbed spikes 34 penetrate the tire wall, dragging cable with the and around wheel and axle, skidding and stopping the vehicle.

Figure 11:
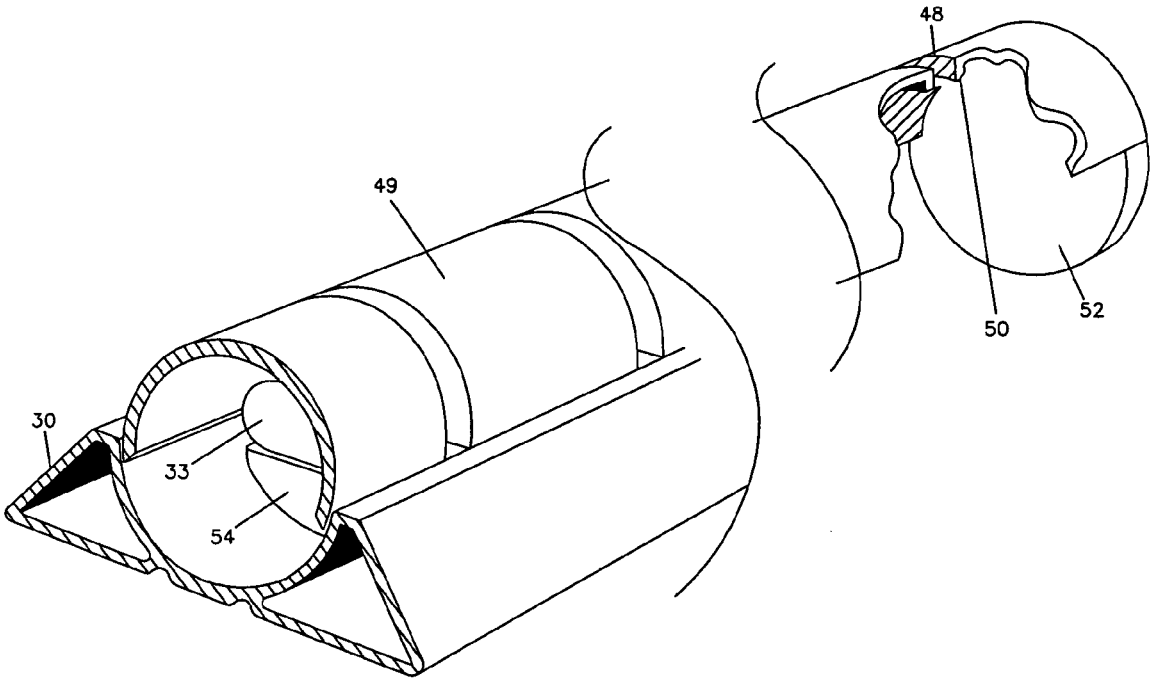
FIG. 11 is an isometric view of the present invention.

The device is armed when the rotating top of the first external assembly ("speed bump") is rotated 180 degrees. The means to accomplish this is shown in the sequence of FIGS. 11 through 13. In FIG. 11, the device is shown in disarmed mode, with the two-piece external assembly clearly shown and comprising the triangular base and half-circular rotating top 49.

The top presents slots 48 spaced regularly along its length, with a ribbed design 50 to further strengthen these slots 48 for heavy load. The slot provides the leading edge for rotation. This top may be further strengthened with additional ribbing (not shown here). The top is supported at either end with full circular end caps 52, which, cradled in the triangular base, also provide the rotation points for this assembly.

Figure 14:
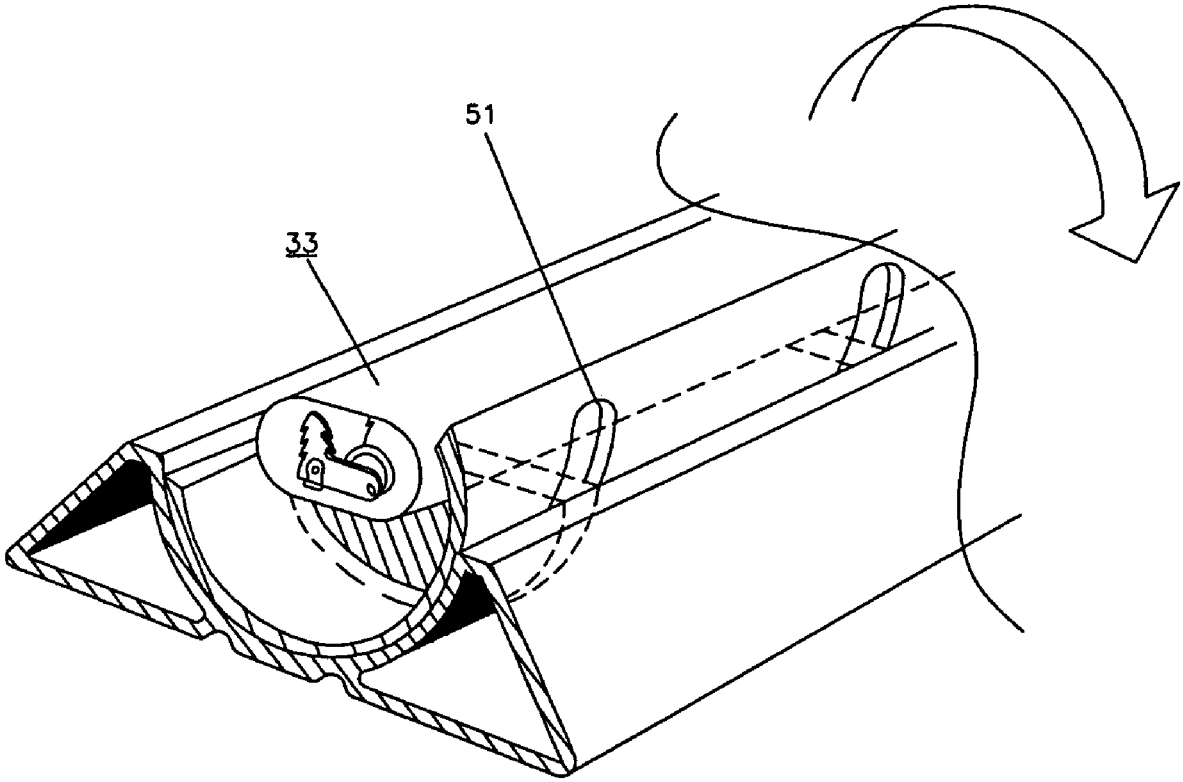
FIG. 14 is a broken away view of the internal mechanism of the third embodiment.

In further explanation of the mechanics of the rotating top, FIGS. 12 to 14 show the internal assembly of the housing. Skid stop 33 is placed on a horizontal plate 55. Support ribs 54 along the circular interior wall 56 of the triangular base provide vertical load support, and a horizontal plate on top of these support ribs and provide the base for the housing. Clearance 61 is provided on both sides between the interior circular wall of the triangular base, and support ribs and horizontal plate sub-assembly. The black section of the rotating top 57 is the point where the slots stop in those sections. Arrow A shows the direction of rotation.

The rotating tub is partially slotted 51, therefore, to allow it to pass through these support ribs, where the ribs and interior circular wall of the triangular base physically interface. Slots and ribs are designed in corresponding fashion to minimize the actual length of the slots.

As shown in FIG. 14, the top is almost completely rotated 180 degrees, exposing the skid-stop housing for the armed mode. As should be noted, this is but one means to accomplish the clearance of the rotating top. It should be further noted that the rotation of this assembly, from disarmed to armed modes, can be remotely operable by hard-wired connection or wireless protocol, allowing safe distance for personnel in either format. Replacement sub-assemblies refit quickly to re-establish device readiness.

It is to be expected that the assembly can be used by itself, separately from the external housing, for vehicle pursuit situations requiring "moving roadblocks" In this scenario, the device is thrown in front of a vehicle literally seconds before impact. For this version of the device, one change to the preferred embodiment of the spike design is proposed: that is, spikes will be positioned in alternating fashion of one with barbs facing left side up, and the next one in sequence with barbs facing right side down, with this sequence repeated along the length of the assembly. In this format, the device can be employed with either side up.

The present invention has been described with reference to the enclosed figures. It is to be appreciated that other embodiments fulfill the spirit and scope of the present invention.

The invention claimed is:

1. A device for stopping a moving vehicle comprising:

a strip to be placed on a roadway in front of the vehicle to be stopped;

said strip having a plurality of spikes for puncturing the tires;

a cable attached to spikes, which unwinds and entwines the axle of the wheels proximate to the tire, stopping the rotation of the wheels; and said spikes having a portion capable of radially expanding within a tire upon piercing the tire.

2. The device for stopping a moving vehicle of claim 1 wherein the cable comprises an elastic material.

3. The device for stopping a moving vehicle of claim 1 wherein the cable comprises reinforced steel.

4. The device for stopping a moving vehicle of claim 1 wherein the cable comprises a synthetic material.

5. The device of claim 1 wherein the spikes expand within the tire through a spring mechanism internal to the spikes which causes barbs on the outside of the spikes to flare outwards upon piercing a tire.

6. The device of claim 5 wherein each spike further comprises:

an aperture at its tip for receiving the compressed air of a pierced tire;

an internal plunger affixed to a spring;

barbs which expand when the plunger is forced downwards by the compressed air of the tire.

7. A device for stopping a moving vehicle comprising:

an inclined strip to be placed on a roadway in front of the moving vehicle;

said strip having a recess for supporting a rotating member, said rotating member having a disarmed position and an armed position having a plurality of recessed spring loaded spikes for thrusting into the front tires of the vehicle when armed;

an elongated cable affixed to the spikes for unwinding and entwining the wheels of the tires as the vehicle advances forward so as to stop the rotation of the tires and thus stopping the vehicle's wheels; and said spring loaded spikes containing barbs capable of radially expanding upon puncturing a tire by operating in conjunction with the spring that is internal to each spike.

8. The device of claim 7 wherein the device may be activated remotely.

* * * * *